US007322053B2

(12) United States Patent
Whitehead

(10) Patent No.: US 7,322,053 B2
(45) Date of Patent: Jan. 29, 2008

(54) PRESSURIZED TOILET CISTERN

(76) Inventor: George Alexander Whitehead, 6 Cushing Crescent, Hospital Park, Bloemfontein, 9301 (ZA)

( * ) Notice: Subject to any disclaimer, the term of this patent is extended or adjusted under 35 U.S.C. 154(b) by 383 days.

(21) Appl. No.: 10/475,109

(22) PCT Filed: Apr. 16, 2002

(86) PCT No.: PCT/ZA02/00066

§ 371 (c)(1),
(2), (4) Date: May 21, 2004

(87) PCT Pub. No.: WO02/084036

PCT Pub. Date: Oct. 24, 2002

(65) Prior Publication Data

US 2004/0187201 A1 Sep. 30, 2004

(30) Foreign Application Priority Data

Apr. 17, 2001 (ZA) ..... 2001/3093

(51) Int. Cl.
*E03D 3/10* (2006.01)

(52) U.S. Cl. ..... 4/354; 4/332; 4/364; 4/376; 4/378; 251/40

(58) Field of Classification Search ..... 4/328, 4/329, 332, 353, 354, 361, 362, 364, 376, 4/378, 359; 222/341; 137/218, 269; 251/40
See application file for complete search history.

(56) References Cited

U.S. PATENT DOCUMENTS

| | | | | |
|---|---|---|---|---|
| 2,793,793 | A * | 5/1957 | Sampson | 4/354 |
| 4,115,883 | A | 9/1978 | Dauvergne | |
| 5,027,444 | A * | 7/1991 | Tsals | 4/354 |
| 5,487,193 | A | 1/1996 | Hennessy | |

FOREIGN PATENT DOCUMENTS

| | | | |
|---|---|---|---|
| DE | 1908970 | A | 9/1970 |
| EP | 0 430 521 | A | 6/1991 |
| WO | WO 9401680 | A1 * | 1/1994 |

* cited by examiner

*Primary Examiner*—Tuan Nguyen
(74) *Attorney, Agent, or Firm*—Nixon Peabody LLP; Donald R. Studebaker

(57) ABSTRACT

A toilet-flushing (1) device comprises a container (2) divided by an elastic diaphragm (3) with a direct unrestricted connection to a water supply under pressure at the lower part of the container (2), with a flushing valve (15) also in the lower part of the container. The water distends the diaphragm (3) so that when the flushing valve (15) is opened, the diaphragm (3) ejects the flushing water fast, allowing a small volume flush to effectively clear the toilet trap (2) and sewer. Extension of the diaphragm can be reduced by having two diaphragms (55), (56), each providing half the flush volume by their extension. Substantial water saving is enabled. A water pressure actuated valve (35) that is well adapted for application to this device is disclosed.

15 Claims, 6 Drawing Sheets

Figure 1:
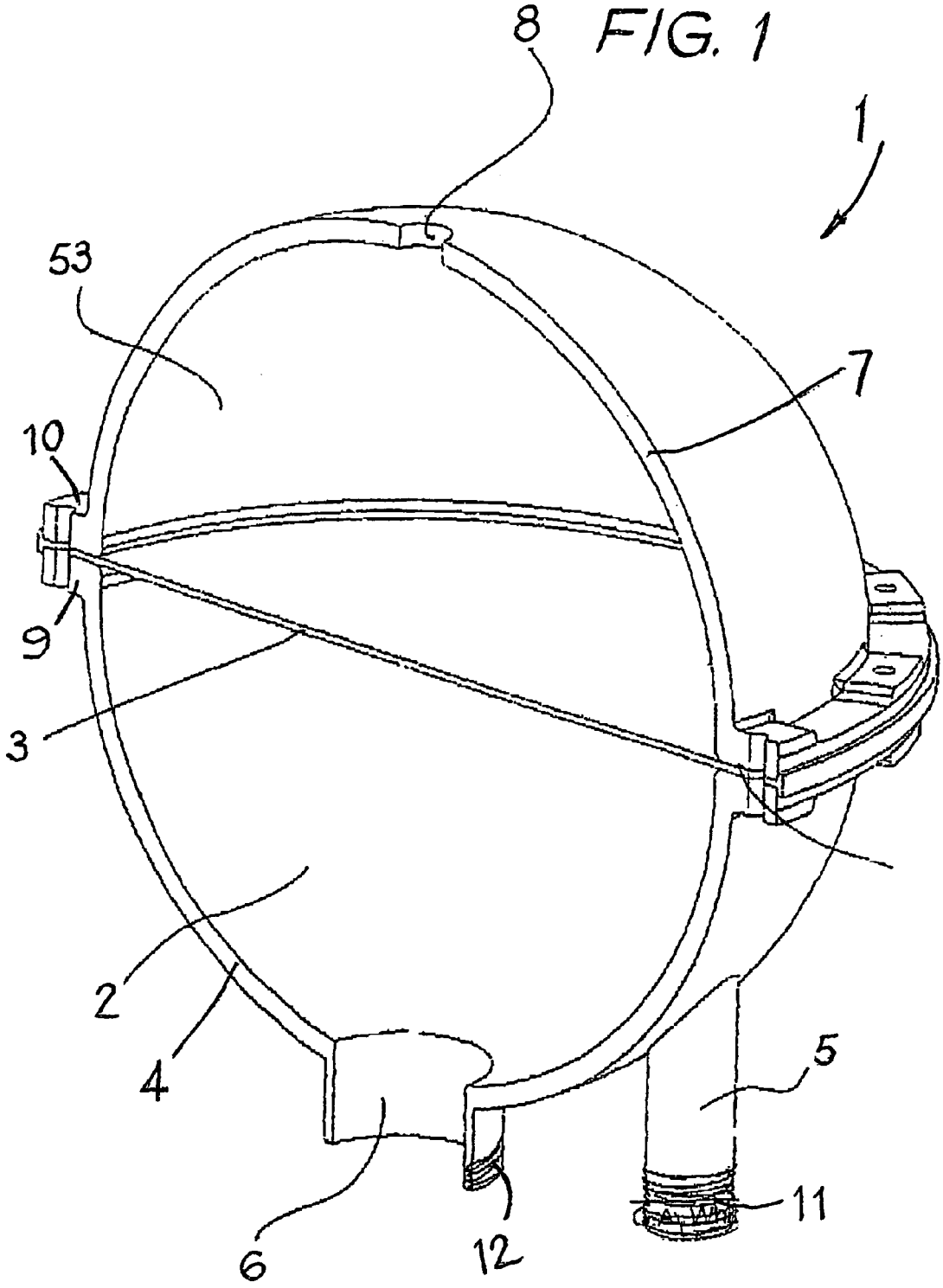

8
1
53
7
10
9
3
2
4
5
6
12
11

63
59
57
60
65
VENT VALVE
CLIP IN TYPE WITH
CAP AND BALL
67
56
62
DOWTY O RING
3D SECTION
206-340
015 COMPRESSION
58
60
59
57
35 SELF TAP SCREW
55
64
66
63
61
VENT VALVE
MOULDED IN TO BODY WITH
CAP AND BALL
PIN TO LOCATE RUBBER DISC
ON TO CENTRE PART
24 PLACES

PRESSURIZED TOILET CISTERN

FIELD OF THE INVENTION

The present invention lies in the field of toilet flushing.

BACKGROUND

Existing toilet cisterns make use of a float valve to control the flow of water into a cistern, from which the water is flushed into toilet bowl under action of gravity on the water in the cistern. A lot of water is required with this system to clear the toilet trap and sewer, between 9 and 13 litres of water are typical. If water can be saved per flush, millions of litres can be saved on a daily basis in many countries of the world.

The inflow of water into a cistern is controlled by a float valve, the result is that it takes quite a while for the cistern to be filled and to be ready for the next flush. This results in public toilets in the bowl often being dirty as the toilet is not ready for the next flush quickly enough.

Because the float valve progressively restricts the inflow of water as the cistern approaches full, a considerable noise is associated with the filling. This noise is particularly objected to in domestic installation.

These three problems with toilet cisterns are in need of a solution.

Time delay valves have been used to flush a toilet bowl, but are not a completely satisfactory solution. The valves limit the flow rate of the flush so that again a lot of water is required to clear the trap and sewer. They have been used more successfully in urinals. The valves also tend to be unreliable.

A design has been proposed that uses an electrically motorised pump to produce the flush that it claims is a powerful and quiet action, with a dual flush option. Whether these claims are met or not is uncertain, but the device has undoubted technical complexity and resulting cost and the undesirable combination of electricity and water, in a domestic or personal use appliance.

The term "toilet" used herein refers to the fixture used to defecate or urinate and having a means of flushing.

There is a need to find a better flushing means.

THE INVENTION

A toilet-flushing device in accordance with the present invention comprises a container for toilet flushing water that is partially enclosed by an elastic membrane or diaphragm and partially by a rigid wall that has an unrestricted connection to a source of water under pressure that is sufficient to extend the membrane and an outlet for a flushing valve operable to release water from the container for a flush of a toilet bowl or urinal.

Preferably the device has a retaining structure to support the diaphragm against excessive extension that could lead to it bursting. Although the retaining structure could be a grid or mesh, it is preferable that it is an in-perforate rigid wall like the wall that has the connection and flushing valve referred to, but with an aperture to allow air to move in a and out as the membrane expands and contracts, in use.

The inlet for water under pressure can be a spigot that is always open, though if desired a non-return valve can be fitted to prevent backflow into the supply pipes. The water under pressure can typically be supplied by municipal mains water under the ordinarily available pressure, or a regulated pressure can be used.

A design has been proposed that uses an electrically motorised pump to produce the flush that it claims is a powerful and quiet action, with a dual flush option. Whether these claims are met or not is uncertain, but the device has undoubted technical complexity and resulting cost and the undesirable combination of electricity and water, in a domestic or personal use appliance.

Toilet flushing mechanisms with an elastic tubular membrane, disc-shaped diaphragm or bag, that accelerates the flush have been proposed, but it has become clear that it is desirable to limit the extent to which the diaphragm or membrane is distended. For example, German Offenlegungschrift 1 908 970 (1969) discloses an elastic tube (elastiche Blase) located in a retaining structure (Behälter) with an inlet (Zulaufrohr) and flushing outlet (Ablaufrohr) controlled by a valve (Verschluss). U.S. Pat. No. 4,115,883 (1978) discloses a single disc-shaped diaphragm (24) in a retaining structure (22,30) with flushing outlet controlled by a valve (34). French patent 1 128 196 A discloses a toilet flushing device that comprises a container for toilet flushing water (vessie en caoutchouc 5) that is partially enclosed by a bag-shaped elastic membrane (vessie 5) and partially by a rigid wall (plaque 9) that has an unrestricted connection to a source of water under pressure that is sufficient to extend the. membrane (tube 10) and an outlet in the rigid wall for a flushing valve operable to release water from the container for a flush of a toilet bowl or a urinal (canal 11) with a retaining structure (réservoir 1) to support the diaphragm against excessive extension that could lead to it bursting (réservoir 1) with an aperture to allow air to move in and out as the membrane expands and contracts, in use.

In these designs it is not possible to limit the distension in a flushing mechanism of acceptable size and it is not possible to compactly locate the flushing valve and control rod inside.

The term "toilet" used herein refers to the fixture used to defecate or urinate and having a means of flushing.

There is a need to find a better flushing means based on a solution to the technical problem of defining an alternative structure that uses elastic diaphragms or membranes while limiting the extent to which the diaphragm or membrane is distended and making it possible to locate the flushing valve inside the flushing means.

THE INVENTION

A toilet-flushing device in accordance with the present invention includes a container for toilet flushing water that is partially enclosed by an elastic membrane or diaphragm and partially by a rigid wall that has an unrestricted connection to a source of water under pressure that is sufficient to extend the membrane and an outlet in the rigid wall for a flushing valve operable to release water from the container for a flush of a toilet bowl or urinal, with a retaining structure to support the diaphragm against excessive extension that could lead to it bursting, the retaining structure being a rigid wall like the wall that has the connection and flushing valve, but with an aperture to allow air to move in and out as the membrane expands and contracts, in use, characterised in that a structure is defined by which the container for toilet flushing water is partially enclosed by two disc-shaped elastic membranes or diaphragms and partially by the rigid wall, which is cylindrical in shape and extends between the peripheries of the two diaphragms, the wall having an unrestricted connection to a source of water under pressure that is sufficient to extend the two membranes and the outlet for a flushing valve located in the space defined by the cylindrical wall, operable to release water from the container for a flush of a toilet bowl or urinal.

The device as mentioned has a retaining structure to support the diaphragm against excessive extension that could lead to it bursting. Although the retaining structure could be a grid or mesh, it is preferable that it is an in-perforate rigid wall like the wall that has the connection and flushing valve referred to, but with an aperture to allow air to move in a and out as the membrane expands and contracts, in use.

The inlet for water under pressure can be a spigot that is always open, though if desired a non-return valve can be fitted to prevent backflow into the supply pipes. The water under pressure can typically be supplied by municipal mains water under the ordinarily available pressure, or a regulated pressure can be used.

The way that the invention works, is that the water under pressure fills the container, distending the diaphragm. Because the inlet is unrestricted, the filling is quick and silent. The distension of the diaphragm stores energy in the diaphragm, which is released when the flushing valve is opened, as the diaphragm ejects the water forcibly in the flush This provides a higher rate of flushing than is usual, which allows a smaller quantity of water to be effective in clearing the trap and sewer. The fact that the inlet for water under pressure remains open does not cause any untoward effect, as the pressure in the container drops the moment the flushing valve is opened so that there is no backflow of water into the supply system (that would be objected to by authorities) and a small inflow does not have any undesired effect The characterising feature of the invention comprises what could be called a "tandem" arrangement of diaphragms, namely the container for toilet flushing water is partially enclosed by two elastic membranes or diaphragms and partially by a rigid wall between the two diaphragms the wall having an unrestricted connection to a source of water under pressure that is sufficient to extend the membranes and an outlet for a flushing valve operable to release water from the container for a flush of a toilet bowl or urinal.

Both membranes preferably have retaining structure, preferably in the form of walls on the outer side of the diaphragms.

An optional feature is to provide a connection from the space on the side of the diaphragm opposite to the space holding the flushing water, that is the enclosed space leading to the trap. The effect achieved by this connection, is that when the flushing valve is opened and the diaphragm relaxes, it draws air from the trap into the space above the diaphragm, this reduces the pressure in the trap and enhances the rate of flush into the trap.

The trap is the space adjoining the toilet bowl to which is connected the soil pipes to the sewer, and is isolated from the bowl by the water level in all toilet bowls, to prevent unpleasant odours from the sewer flowing back.

The invention may also be implemented by means of a spring-loaded piston or pistons in a cylinder or cylinders, instead of the diaphragm(s). The piston will be pressed back along the cylinder, analogously to the diaphragm distending, the spring providing the elastic response that the elasticity of the diaphragm, which is e.g. of rubber, provides. In both cases the incoming water from the pressurised mains supply builds up potential energy, in the diaphragm in the elastic distension, and in a piston in the spring. energy as the spring is tensioned. This energy provides the strong flush that allows use of less water.

The flush valve may be selected from suitable valves available, as well as the means of opening and closing it, for a flush. A large opening is sought after and, for example, pressure balanced valves and pressure actuated valves, which balance pressure generated forces or give a servo-type enhancement to allow a light mechanical control, can be a good choice. The present invention provides a design of valve that is well adapted to use with the invention.

According to a preferred embodiment, the toilet-flushing device of the invention further includes a flushing valve connected to the flushing outlet of the container, which valve comprises a valve seat, a diaphragm including a plug that can seat on the valve seat, a wall joining with the diaphragm to enclose a space within the diaphragm and wall, an aperture in the plug upstream of the valve seat, a control aperture in the wall downstream of the seat, that can be closed and opened by a control means operable by a. user of the toilet-flushing device.

This valve uses the pressure of the water in the container to move the valve plug from open to closed and closed to open. This allows control of the valve for flushing to be effective and easy over a range of water pressures, e.g. as may occur from different municipalities and differing locations in a municipal system.

The device preferably has a valve of a type that will close if the diaphragm develops a leak or bursts, to ensure that there will be no water leakage in that event. The valve can, for example, be a ball that is lifted to a closed position by water but not by air, so that the valve allows the air to move freely in and out of a space between the diaphragm and the retaining structure wall.

THE DRAWINGS

The invention will be more fully described by way of examples, with reference to the drawings, in which:-

Figure 2:
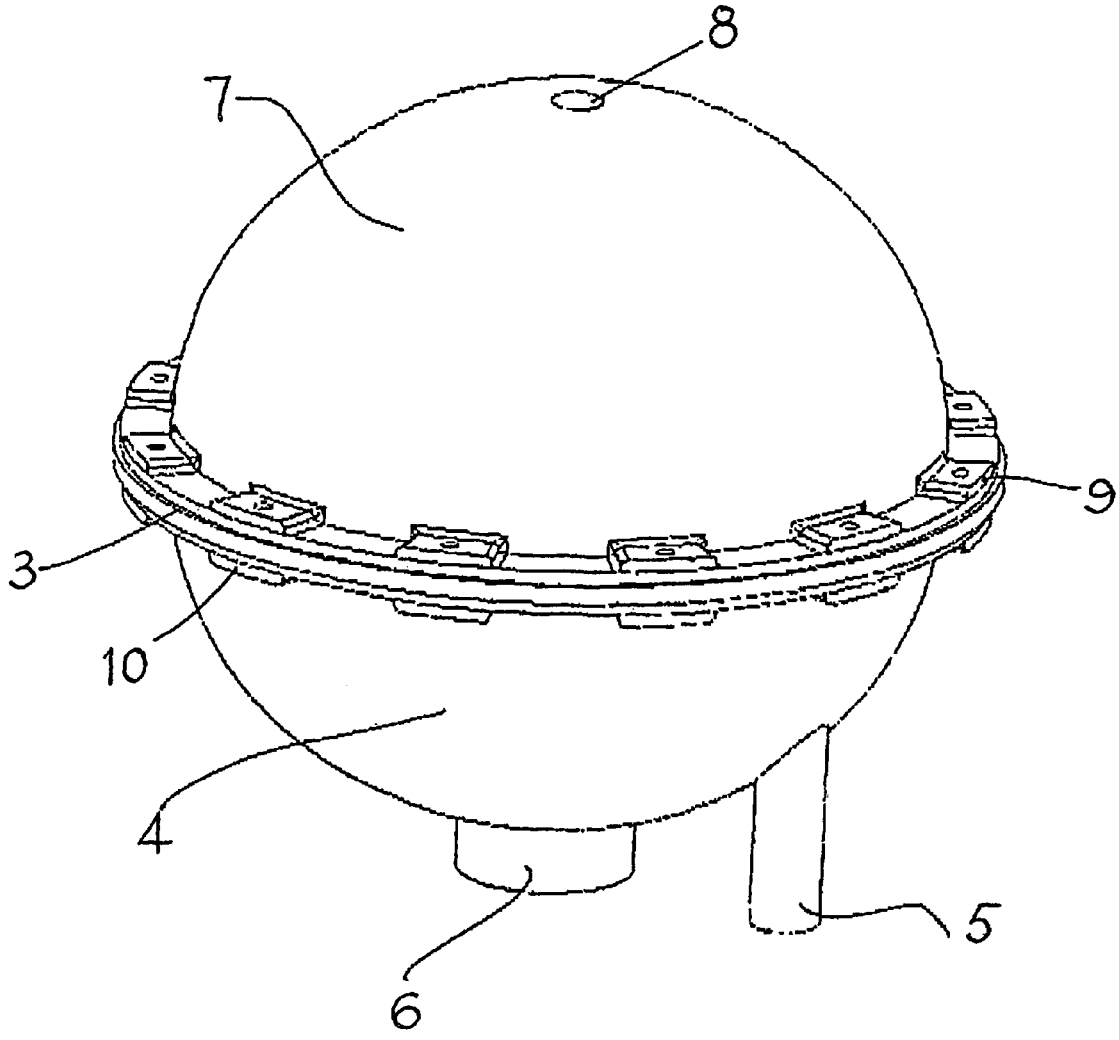
Figure 3:
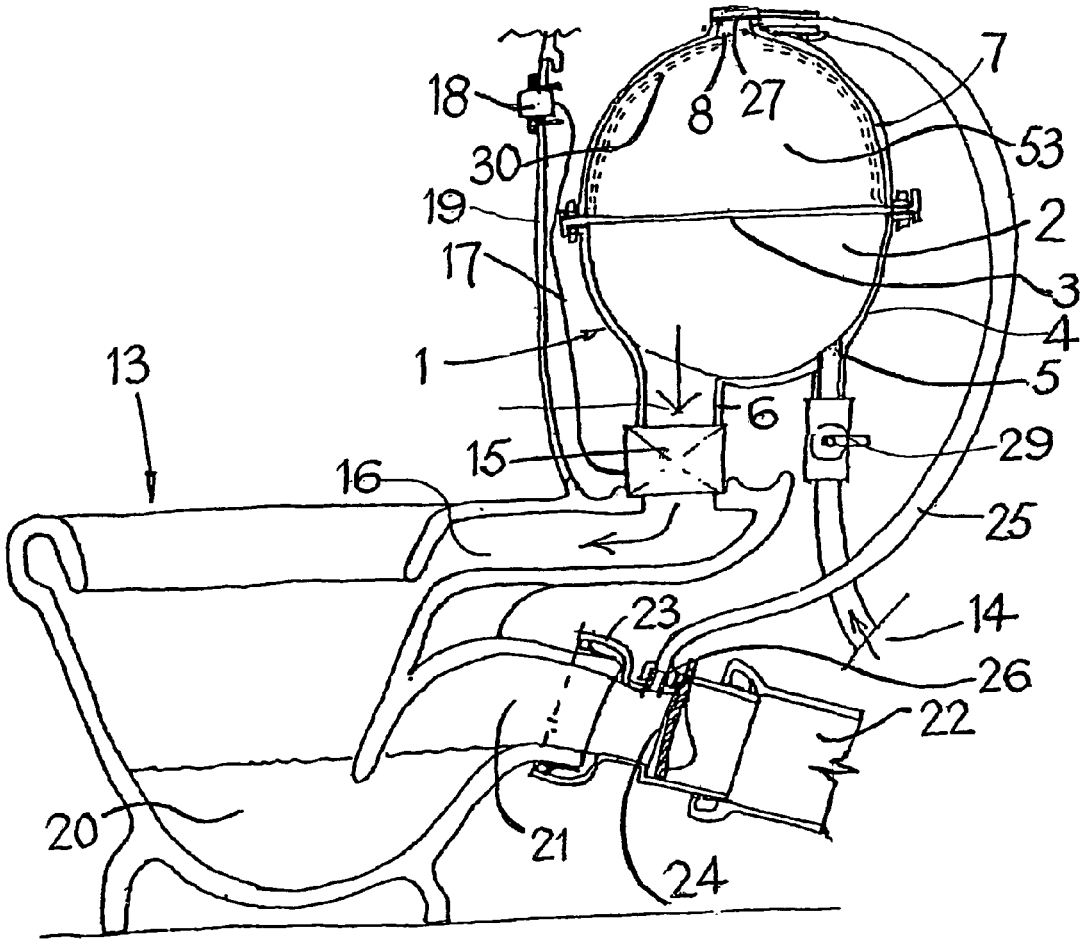
Figure 4A:
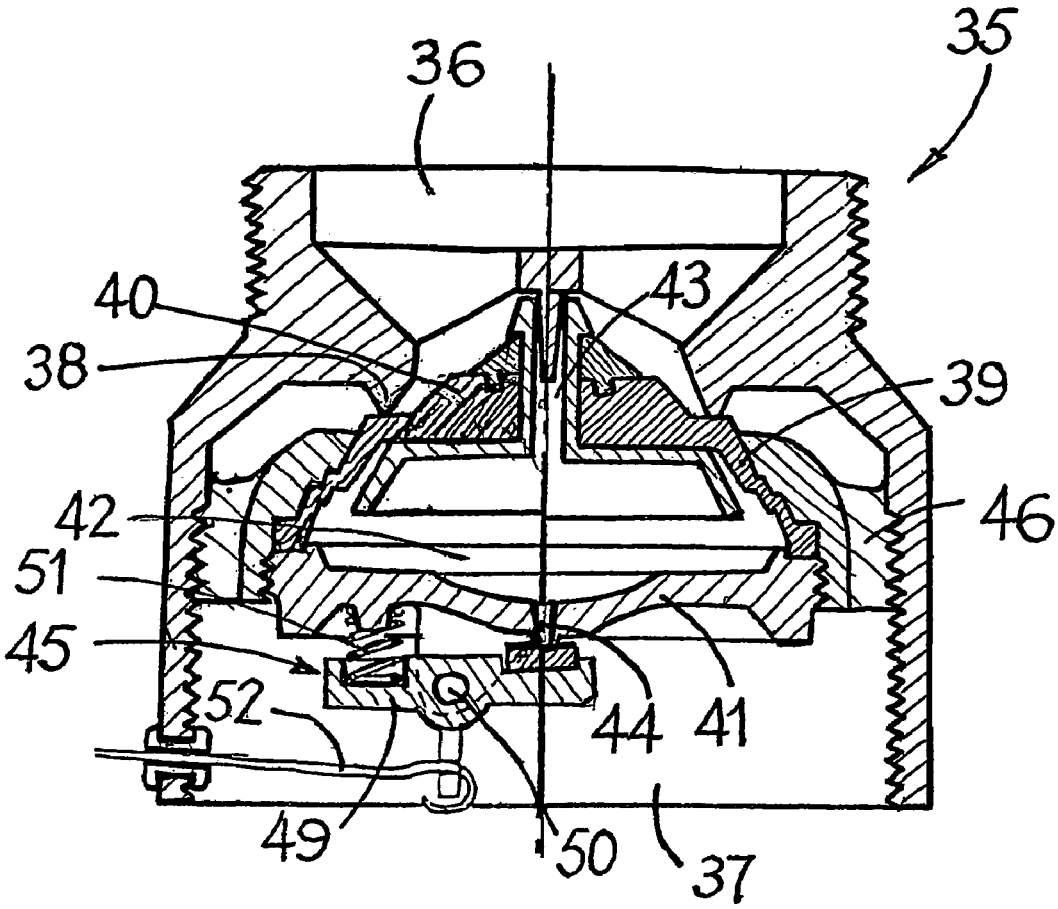
Figure 4B:
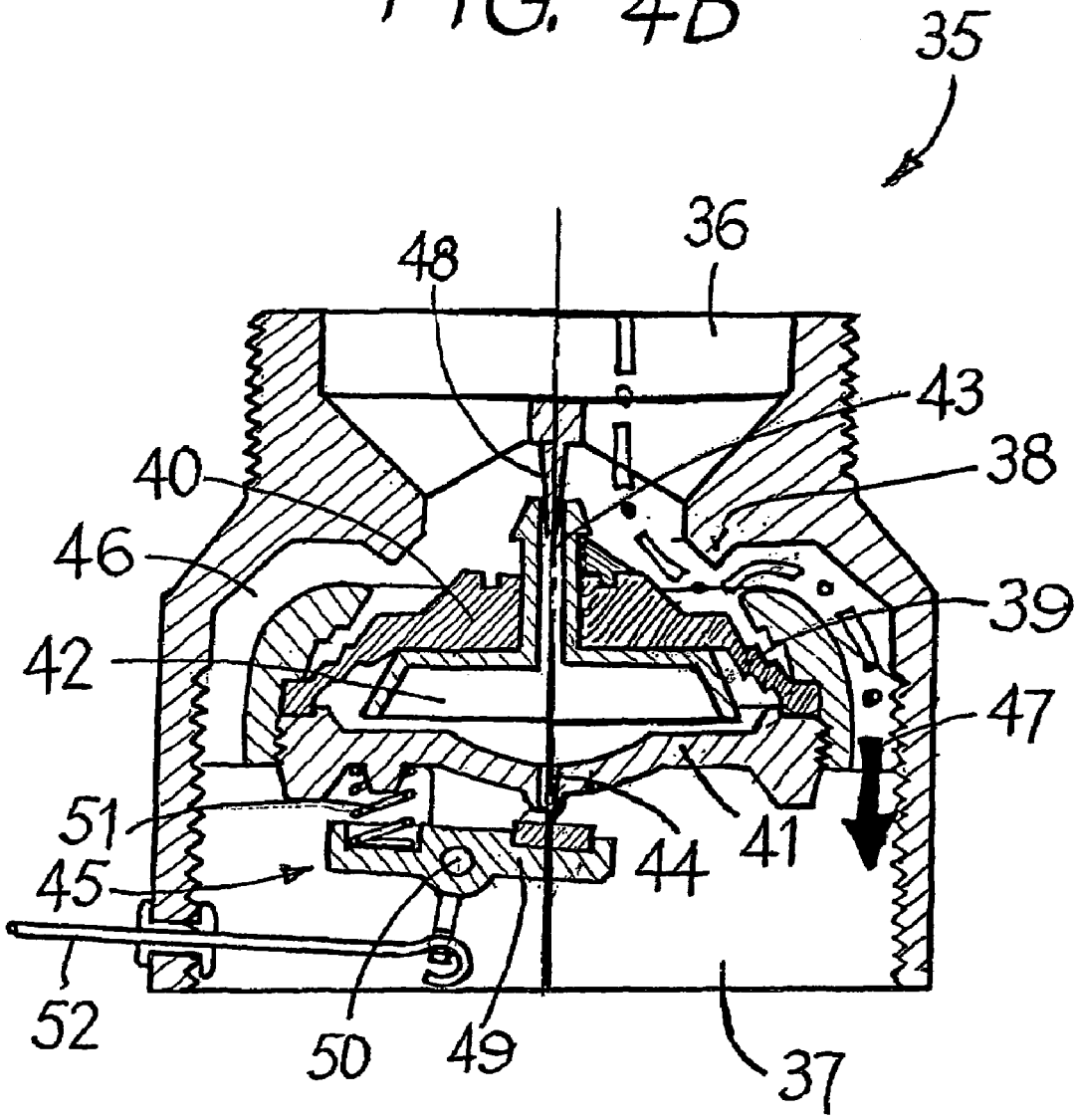
Figures 5, 6:
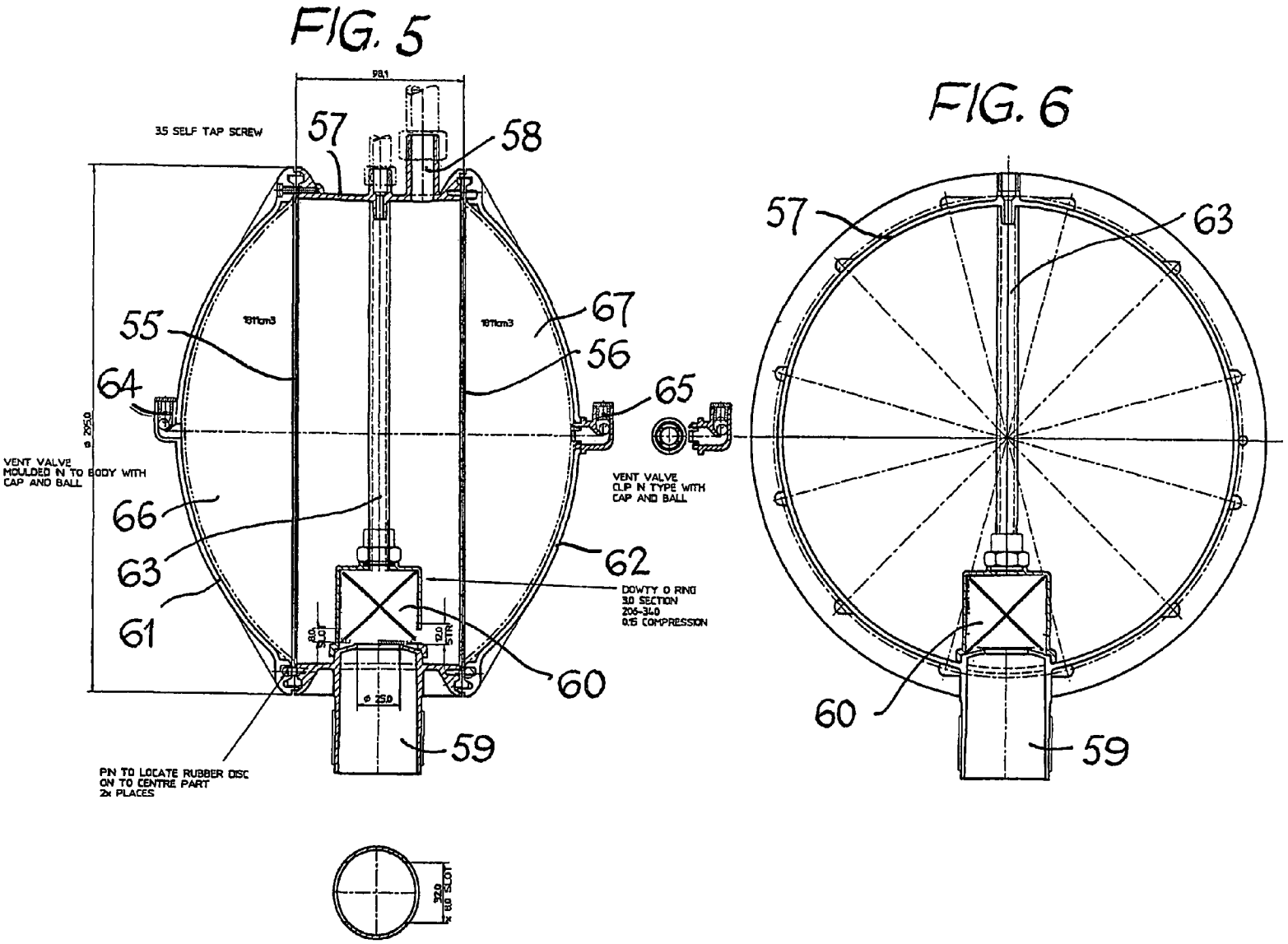

FIG. 1 is an isometric view of a toilet-flushing device not according to an embodiment of the invention, sectioned in half for illustration purposes, FIG. 2 is an isometric view of the device, FIG. 3 is a schematic drawing of a sectioned view of an installation of the device on a toilet bowl, FIG. 4A is a sectioned view of a flushing valve provided as a preferred feature of the invention, in a closed position, FIG. 4B is a sectioned view of the flushing valve, in an open position, FIG. 5 is a sectioned view of a device according to the preferred embodiment of the invention, and FIG. 6 a sectioned elevation of the preferred device

THE PREFERRED EMBODIMENTS

FIGS. 1 and 2 are not according to the invention, this toilet-flushing device 1 comprises a container 2 for toilet flushing water that is partially enclosed by an elastic membrane or diaphragm 3 and partially by a rigid wall 4 that has an open spigot 5 for unrestricted connection to a source of water under pressure that is sufficient to extend the membrane and an outlet 6 for a flushing valve operable to release water from the container for a flush of a toilet bowl or urinal.

The device has a retaining structure to support the diaphragm against excessive extension that could lead to it bursting, in the form of a rigid wall 7 like the wall that has the connection and flushing valve referred to, but with an aperture 8 to allow air to move in a and out as the membrane expands and contracts, in use. A ball can be put in the space 53 above the diaphragm so that if the diaphragm should perish and break the ball will be driven into the hole 8 to close it and prevent flooding.

The two walls 4 and 7 have flanges 9 and 10 respectively that are bolted together, clamping the diaphragm between them. Though shown as of equal dimensions, the top wall 7 does not have to be the same size as the bottom wall 4. Bolts are used at the flanges to clamp them together. The walls 4 and 7 thus form a container divided by the diaphragm 3.

The inlet is threaded at 11 and the outlet is threaded at 12, for appropriate connections.

FIG. 3 shows the device 1 connected with a toilet bowl 13 and a municipal water supply 14, for use. The same reference numerals are used for the device as were used in FIGS. 1 and 2. The invention can be applied to this installation.

The device has a flushing valve 15 attached to it, communicating with the flushing passages 16 of the toilet bowl. The flushing valve has a connection 17 to a manual actuator 18 mounted in a partition or wall 19 that hides the container from sight. The toilet bowl has water in it at 20, providing the odour seal from the trap 21. The trap is connected to the soil pipes 22 and sewer by a connector 23. A flap valve 24 is shown, being an optional feature.

A pipe 25 connects from a fitting 26 in the connector to a fitting 27 applied to the aperture 8 at the top of the container. The pipe provides communication from the space 53 above the diaphragm 3 to the space in the trap 21.

The inlet pipe 14 has a stop-cock 29 that is normally kept open and only used to isolate water supply under pressure if the container must be disconnected for servicing.

The container holds six litres of water for the flush, when the diaphragm is in the position indicated by the broken lines 30, having been distended to that position by the water under pressure entering via the spigot 5. The quantity of 3 litres compares very favourably with 9 to 12 litres typical in toilet cisterns, leading to potential for water saving of millions of litres in large cities and in countries at large. Given a typical cost of water, enormous savings in monetary terms are attainable. As mentioned because the spigot allows unrestricted flow into the container the time to fill it is less than in the case of a float controlled cistern and the filling is silent. The device is then ready for a flush.

When the flushing valve is actuated, the tension in the diaphragm expels the water from the container at higher speed than occurs in the case of a typical gravity actuated flush from a toilet cistern. This is what allows the flush to be effective in clearing the trap and downstream the sewer.

Specifications have been developed by the South African Bureau of Standards (SABS), which is an accredited standards authority with the international bureau of standards authorities. This standard, under SABS 1733:1998 for water closet (toilet bowl) flushing systems requires the use of 50 balls produced form a non-absorbent, durable material, of diameter 19.0 mm and of a relative density between 0.85 and 0.88, in a prescribed test procedure. The 50 balls are placed in the toilet bowl, filled to its normal level. The bowl is then flushed with one full flush and the number x of balls that remain in the bowl is recorded. The standard then allows for up to three more flushes to empty the trap of all balls, the number y of additional flushes required is recorded. The following formula is used to get to a number R:

$$R=100-2x-7y^2$$

R must be more than 60 for a flushing system to conform to standard. A prototype of this invention made according to this embodiment scored 93 for R.

The device is smaller than a cistern and can be made in a prolate spheroidal or other shape rather than a spherical shape, for example, to make it even more space saving. The device lends itself to attachment or even integral manufacture with the toilet bowl, due to its compactness.

Typical water supply pressures that are met with range between 2 bar and 6 bar (between 200 kPa and 600 kPa). If desired, the inlet can be given a pressure regulator valve provided that it is of a design that will not restrict the rate of inflow into the container, however, a better option is to use a suitable valve that does not require a controlled pressure.

FIGS. 4A and 4B show a valve that has been designed to be used with the invention.

The valve 35 is connected at inlet 36 to the flushing outlet 6 of the container and at outlet 37 to the flushing passages 16 of the toilet bowl. The valve comprises a valve seat 38, a diaphragm 39 with which is integrally formed a plug 40 that can seat on the valve seat, a wall 41 joining with the diaphragm to enclose a space 42 within the diaphragm and wall. An aperture 43 in the plug upstream of the valve seat, a control aperture 44 in the wall downstream of the seat, that can be closed and opened by a control means 45 operable by a user of the toilet-flushing device.

When the aperture 44 is closed the water pressure at inlet 36 enters the space 42 via the aperture 43 and distends the diaphragm moving the plug until it seals against the seat 38, as shown in FIG. 4A The water under pressure will then distend the diaphragm 3 in the container 1 (FIG. 3) preparing the device for a flush.

When the aperture 44 is opened the water in the space 42 discharges through the aperture 44 and the diaphragm moves off the seat 38, allowing a flush to take place. The passages 46 are made large enough to allow a fast flush, as indicated by the arrows 47.

The inlet end of the valve is provided with a tapered needle valve 48 to provide a gradual closing of the valve onto the valve seat, so as to avoid a violent action that could cause damage or water hammer.

The control means 45 comprises a lever 49 pivoted at 50 with a spring 51 urging it to close the aperture 44 and a rod or wire (cable) 52 to open it when a flush is required. The valve is thus normally closed and opens when actuated. The valve could alternatively be electrically operated.

Structural aspects of the design are apparent from the drawing to the trained eye. Materials can be suitable types and grades of plastics, injection moulded and rubbers for the diaphragms. Design techniques can easily attain say up to 30 bar (3 mPa) ultimate strength and a safety relief valve can be provided.

FIGS. 5 and 6 show the preferred design according to the invention. It has become clear that it is desirable to limit the extent to which the diaphragm is distended. Suppliers advise that their particular product be limited to a maximum distention of 15%.

In order to achieve this, a solution is the design shown in these two figures, where the total volume flush is provided by two diaphragms, thus halving the degree of distention required of the diaphragm.

Thus the device comprises a container 54 for toilet flushing water that is partially enclosed by two elastic diaphragms 55 and 56 and partially by a rigid wall 57 that has an unrestricted connection 58 to a source of water under pressure that is sufficient to extend the membranes and an outlet 59 for a flushing valve 60 operable to release water from the container for a flush of a toilet bowl or urinal.

The device has a retaining structure 61 and 62 to support the diaphragms against excessive extension that could lead to leaks or bursting. The valve 60 is controlled by means of a rod or tube 63, the valve and the control not being described with reference to these figures of the drawings. The retaining structures are un-perforated walls as shown and have holes with vents 64 and 65, designed to allow air to move into and out of the spaces 66 and 67 that are behind the diaphragms. The vents, however, each have a small ball valve that will close the vent if water starts to issue from the vent, thus preventing flooding if the either diaphragm starts a leak or bursts.

The invention claimed is:

1. A toilet-flushing device, comprising; a container for toilet flushing water, that is partially enclosed by two disc-shaped elastic membranes and partially by a rigid wall, which is cylindrical in shape and extends between the peripheries of the two membranes, the cylindrical wall having an unrestricted connection to a source of water under pressure that is sufficient to extend the two membranes and an outlet for a flushing valve located in a space defined by the cylindrical wall operable to release water from the container for a flush of a toilet bowl or urinal, a retaining structure to support the membranes against excessive extension, the retaining structure being a rigid wall with an aperture to allow air to move in and out as the membrane expands and contracts, wherein the toilet-flushing device further includes a flushing valve connected to the flushing outlet of the container, which valve comprises a valve seat, a diaphragm including a plug that can seat on the valve seat, a wall joining with the diaphragm to enclose a space within the diaphragm and the wall, an aperture in the plug upstream of the valve seat, and a control aperture in the wall downstream of the seat, that can be closed and opened by a control means operable by a user of the toilet-flushing device.

2. A toilet-flushing device, comprising:

a container for toilet flushing water; wherein the container is partially enclosed by an elastic membrane and partially by a rigid wall that has an unrestricted connection to a source of water under pressure that is sufficient to extend the membrane and an outlet in the rigid wall for the flushing valve operable to release water from the container for a flush of a toilet bowl or urinal; and a flushing valve connected to a flushing outlet of the container, which valve comprises a valve seat, a diaphragm including a plug that can seat on the valve seat, a wall joining with the diaphragm to enclose a space within the diaphragm and the wall, an aperture in the plug upstream of the valve seat, and a control aperture in the wall downstream of the seat, that can be closed and opened by a control means operable by a user of the toilet-flushing device.

3. The toilet flushing device as claimed in claim 2, wherein the device has a retaining structure to support the diaphragm against excessive extension, the retaining structure being a rigid wall with an aperture to allow air to move in and out as the membrane expands and contracts.

4. The toilet flushing device as claimed in claim 2, wherein the inlet for water under pressure is a spigot that is always open, save for a non-return valve fitted to prevent backflow into the supply pipes.

5. The toilet flushing device as claimed in claim 2, wherein a connection from the space above the diaphragm that is enclosed to a trap is provided, so that when the flushing valve is opened and the membrane relaxes, it draws air from the trap into the space above the membrane and reduces the pressure in the trap and enhances the rate of flush into the trap.

6. The toilet flushing device as claimed in claim 2, wherein the container for toilet flushing water is partially enclosed by two elastic membranes and partially by a rigid wall between the two membranes.

7. A toilet-flushing device, comprising;

a container for toilet flushing water; wherein the container is partially enclosed by an elastic membrane and partially by a rigid wall that has an unrestricted connection to a source of water under pressure that is sufficient to extend the membrane and an outlet in the rigid wall for the flushing valve operable to release water from the container for a flush of a toilet bowl or urinal and a retaining structure to support the membrane against excessive extension, the retaining structure being a rigid wall with an aperture to allow air to move in and out as the membrane expands and contracts, and a flushing valve connected to the flushing outlet of the container, which valve comprises a valve seat, a diaphragm including a plug that can seat on the valve seat, a wall joining with the diaphragm to enclose a space within the diaphragm and the wall, an aperture in the plug upstream of the valve seat, and a control aperture in the wall downstream of the seat, that can be closed and opened by a control means operable by a user of the toilet-flushing device.

8. The toilet flushing device as claimed in claim 7, wherein the inlet for water under pressure is a spigot that is always open, save for a non-return valve fitted to prevent backflow into the supply pipes.

9. The toilet flushing device as claimed in claim 7, wherein a connection from the space above the diaphragm that is enclosed to a trap is provided, so that when the flushing valve is opened and the membrane relaxes, it draws air from the trap into the space above the membrane and reduces the pressure in the trap and enhances the rate of flush into the trap.

10. The toilet flushing device as claimed in claim 7, wherein the container for toilet flushing water is partially enclosed by two elastic membranes and partially by a rigid wall between the two membranes.

11. A toilet-flushing device, comprising:

a container for toilet flushing water; wherein the container is partially enclosed by an elastic membrane and partially by a rigid wall that has an unrestricted connection to a source of water under pressure that is sufficient to extend the membrane and an outlet in the rigid wall for the flushing valve operable to release water from the container for a flush of a toilet bowl or urinal, and the inlet for water under pressure is a spiggot that is always open, save for a non-return valve fitted to prevent backflow into the supply pipes; and a flushing valve connected to the flushing outlet of the container, which valve comprises a valve seat, a diaphragm including a plug that can seat on the valve seat, a wall joining with the diaphragm to enclose a space within the diaphragm and the wall, an aperture in the plug upstream of the valve seat, and a control aperture in the wall downstream of the seat, that can be closed and opened by a control means operable by a user of the toilet-flushing device.

12. The toilet flushing device as claimed in claim 11, wherein a connection from the space above the diaphragm that is enclosed to a trap is provided, so that when the flushing valve is opened and the membrane relaxes, it draws air from the trap into the space above the membrane and reduces the pressure in the trap and enhances the rate of flush into the trap.

13. The toilet flushing device as claimed in claim 11, wherein the container for toilet flushing water is partially enclosed by two elastic membranes and partially by a rigid wall between the two membranes.

14. A toilet-flushing device comprising;

a container for toilet flushing water; wherein the container is partially enclosed by an elastic membrane and partially by a rigid wall that has an unrestricted connection to a source of water under pressure that is sufficient to extend the membrane and an outlet in the rigid wall for the flushing valve operable to release water from the container for a flush of a toilet bowl or urinal, and a flushing valve connected to the flushing outlet of the container, which valve comprises a valve seat, a diaphragm including a plug that can seat on the valve seat, a wall joining with the diaphragm to enclose a space within the diaphragm and the wall, an aperture in the plug upstream of the valve seat, and a control aperture in the wall downstream of the seat, that can be closed and opened by a control means operable by a user of the toilet-flushing device;

wherein a connection from a space above the membrane that is enclosed to a is provided, so that when the flushing valve is opened and the membrane relaxes, air is drawn from the trap into the space above the membrane and reduces the pressure in the trap and enhances the rate of flush into the trap.

15. A toilet-flushing device, comprising:

a container for toilet flushing water; and wherein the container is partially enclosed by two elastic membranes and partially by a rigid wall between the two membranes that has an unrestricted connection to a source of water under pressure that is sufficient to extend the membrane and an outlet in the rigid wall for the flushing valve operable to release water from the container for a flush of a toilet bowl or urinal; and a flushing valve connected to the flushing outlet of the container, which valve comprises a valve seat, a diaphragm including a plug that can seat on the valve seat, a wall joining with the diaphragm to enclose a space within the diaphragm and the wall, an aperture in the plug upstream of the valve seat, and a control aperture in the wall downstream of the seat, that can be closed and opened by a control means operable by a user of the toilet-flushing device;

wherein a connection from a space above the membrane that is enclosed to a trap is provided, so that when the flushing valve is opened and the membrane relaxes, air is drawn from the trap into the space above the membrane and reduces the pressure in the trap and enhances the rate of flush into the trap.

* * * * *